US012297021B2

(12) United States Patent
Zanotti et al.

(10) Patent No.: US 12,297,021 B2
(45) Date of Patent: May 13, 2025

(54) PACKAGE ASSEMBLY AND METHOD FOR PRODUCING THE PACKAGE ASSEMBLY

(71) Applicant: Tetra Laval Holdings & Finance S.A., Pully (CH)

(72) Inventors: Giorgia Zanotti, Carpi (IT); Marcello Barbieri, Modena (IT); Pietro Martini, Parma (IT); Anna Genowefa Engelbrecht, MJ Hoofddorp (NL); James Maxwell Eelbeck, Portishead (GB); John Robert Cowan-Hughes, Bristol (GB); Thomas Zoltan Harkin, Bristol (GB); Alessandro Benzi, Rome (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 948 days.

(21) Appl. No.: 17/310,407

(22) PCT Filed: Jan. 29, 2020

(86) PCT No.: PCT/EP2020/052161
§ 371 (c)(1),
(2) Date: Jul. 30, 2021

(87) PCT Pub. No.: WO2020/160977
PCT Pub. Date: Aug. 13, 2020

(65) Prior Publication Data

US 2022/0089343 A1 Mar. 24, 2022

(30) Foreign Application Priority Data

Feb. 7, 2019 (EP) ..... 19155906

(51) Int. Cl.
*B65D 71/00* (2006.01)
*B65D 5/44* (2006.01)
(Continued)

(52) U.S. Cl.
CPC ..... *B65D 71/0085* (2013.01); *B65D 5/445* (2013.01); *B65D 5/746* (2013.01); *B65D 53/00* (2013.01); *B65D 2575/586* (2013.01)

(58) Field of Classification Search
CPC .... B65D 71/0085; B65D 5/445; B65D 5/746; B65D 53/00; B65D 2575/586;
(Continued)

(56) References Cited

U.S. PATENT DOCUMENTS 5,419,431 A * 5/1995 Neuber ..... B65D 5/5495 206/256
2004/0011688 A1* 1/2004 Ishikawa ..... B65D 5/746 53/434
2006/0255110 A1* 11/2006 Kaneko ..... B65D 5/746 229/125.42

FOREIGN PATENT DOCUMENTS

EP 2650223 10/2013
WO WO-9222470 A1 * 12/1992 ..... B65D 71/403
(Continued)

OTHER PUBLICATIONS

International Sear Report and Written Opinion of PCT/EP2020/052161, Dated Feb. 18, 2020 in 9 pages.

*Primary Examiner* — Don M Anderson
*Assistant Examiner* — John Martin Hoppmann
(74) *Attorney, Agent, or Firm* — Knobbe, Martens, Olson & Bear, LLP

(57) ABSTRACT

A package assembly (300, 400, 500) comprising a package (100, 302) arranged to hold a food product, wherein the package (100,302) comprises a rear section (140) provided with a longitudinal seal (LS), and an exoskeleton (308, 402, 502, 600, 700, 800, 900, 1000, 1100, 1200, 1300) attached to the rear section (140) of the package (100,302) such that an improved robustness is achieved and that the longitudinal seal (LS) is protected.

12 Claims, 8 Drawing Sheets

(51) Int. Cl.
*B65D 5/74* (2006.01)
*B65D 53/00* (2006.01)

(58) Field of Classification Search
CPC ..... B65D 77/042; B65D 2571/0066; B65D 5/064; B65D 51/24; B65D 51/26; B65D 7/48; B65D 7/44; B65D 1/40; B65D 1/48; B65B 13/02; B31B 2120/50
USPC ..... 206/431, 205, 764; 220/668; 229/120.07, 122.32; 53/449
See application file for complete search history.

(56) References Cited

FOREIGN PATENT DOCUMENTS

| | | | | |
|---|---|---|---|---|
| WO | WO 2014/014738 | | 1/2014 | |
| WO | WO 2016/173907 | | 11/2016 | |
| WO | WO-2016173907 | A1 * | 11/2016 | ..... B65D 5/064 |

* cited by examiner

PACKAGE ASSEMBLY AND METHOD FOR PRODUCING THE PACKAGE ASSEMBLY

TECHNICAL FIELD

The invention generally relates to liquid food packaging. More particularly, it is related to a package assembly with improved support and protection properties, a multi-pack comprising a number of package assemblies, a method for producing the package assembly and a method for producing the multi-pack.

BACKGROUND ART

Today it is well known to produce carton packages filled with liquid food products, e.g. Tetra Brik™ packages filled with milk. The Tetra Brik™ packaging machine is an example of a roll-fed packaging machine, sometimes also referred to as a roll-fed filling machine. In the roll-fed packaging machine a web of packaging material, provided to the packaging machine on a reel, is formed into a tube and a longitudinal sealing is provided. After having formed the tube and provided the longitudinal sealing, the tube is filled with product. From a lower end of the tube, transversal sealings are continuously made. In connection with making the transversal sealings, the lower end of the tube is cut off such that packages filled with liquid product are formed. These packages are thereafter transferred to a folding device that folds the packages into their final form by making use of pre-made folding lines, sometimes also referred to as weakening lines, provided in the packaging material.

Another type of packaging machine is so-called blanks-fed packaging machines. Unlike the roll-fed packaging machine, the packages are made one by one in the blanks-fed packaging machine. Another difference among the two is that the longitudinal sealing is not made in the packaging machine, but is pre-made. A blank is thus in this context to be seen as a sleeve-shaped piece of packaging material. In the blanks-fed packaging machine, the blank is erected, i.e. unfolded such that an inner space is formed. After being erected a closed end is formed by providing a transversal sealing in one end of the sleeve. In a next step product is filled into the sleeve and thereafter another end of the sleeve is closed by providing a transversal seal such that a closed package is formed.

After having produced the packages, either by the roll-fed packaging machine or the blanks-fed packaging machine, these are transferred to secondary packaging machines. The secondary packaging machines are often used for forming multi-packs by combining e.g. three packages, often referred to as primary packages in this context, into a group of packages, placing the group on a cardboard tray, and finally wrapping the group and the tray with a plastic film. After having provided the secondary packaging, the packages are transferred to a palletizer that stacks the secondary packages holding the packages on a pallet.

Different multi-pack solutions have been provided over the years. Most often, in these solutions, the secondary packages are not attached to the primary packages, but there are examples in which the secondary packages are glued to the primary packages. For instance, in WO2016/173907, filed by Tetra Laval Holding & Finance, it is suggested that the secondary package can be attached to the primary package such that a space can be formed between the two. This is advantageous for example in that a straw can be placed in the space such that this is reliably held during transportation and distribution of the packages.

Even though some of the multi-packs offered today provide protection of the packages, there is still room for packaging solutions with improved properties for withstanding transport and distribution damages.

SUMMARY

It is an object of the invention to at least partly overcome one or more of the above-identified limitations of the prior art. In particular, it is an object to provide a package assembly that can withstand transport and distribution damages.

According to a first aspect is provided a package assembly comprising a package arranged to hold a food product, wherein the package comprises a rear section provided with a longitudinal seal, an exoskeleton attached to the rear section of the package such that an improved robustness is achieved and that the longitudinal seal is protected.

The package may comprise a top section provided with a top transversal seal, and the exoskeleton may be arranged to face the top section such that the top transversal seal is protected.

The top transversal seal may be provided in a top fin, and the top fin may be folded towards the longitudinal seal, wherein the exoskeleton may be arranged to face the top fin that forms part of the top section such that the top fin is held in place.

The package may further comprise a bottom section provided with a bottom transversal seal, and the exoskeleton may be attached to the bottom section such that the bottom transversal seal is protected.

The top section may be provided with an opening device, and the exoskeleton may comprise a rear section element attached to the rear section of the package, and a top protection arrangement arranged to be in a protective state and a non-protective state, said top protection arrangement comprises a first element that in the protective state is arranged to face the top section of the package, a second element that in the protective state is arranged to form a stacking surface of the package assembly, and a third element connected to the first and second element, and that in the protective state is arranged to provide a distance between the first and second element such that a space is formed.

The opening device may be a cap, and the first element may be provided with a first opening for holding the cap in the protective state, and the space may be arranged for holding the cap in the protective state between the first and second element.

The second element may be provided with a second opening for holding the cap in the protective state.

The top section may be a slanted top section.

The package may comprise a side section placed next to the rear section, and an intermediate section placed between the rear section and the side section, wherein the exoskeleton may be attached to the intermediate section.

The exoskeleton may comprise a cardboard layer.

According to a second aspect it is provided a multi-pack comprising a number of package assemblies according to the first aspect, wherein a number of exoskeletons of the number of package assemblies are attached to each other.

Rear section elements of the number of package assemblies may be attached to each other in a first attachment section and a second attachment section, wherein the first and second attachment sections are spaced apart from each other.

Bottom section elements of the exoskeletons may be attached to each other.

According to a third aspect it is provided a method for producing a package assembly comprising a package arranged to hold a food product, wherein the package comprises a rear section provided with a longitudinal seal, and an exoskeleton, said method comprising providing the package, and attaching the exoskeleton to the rear section of the package such that an improved robustness is achieved and that the longitudinal seal is protected.

According to a fourth aspect it is provided a method for producing a multi-pack comprising a number of package assemblies, each comprising a package arranged to hold a food product, wherein each package comprises a rear section provided with a longitudinal seal, wherein a number of exoskeletons of the number of package assemblies are attached to each other, said method comprising providing the packages, and attaching the number of exoskeletons to the rear sections of the packages such that an improved robustness is achieved, that the longitudinal seals (LS) are protected, and that the number of packages are attached to each other.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1A:
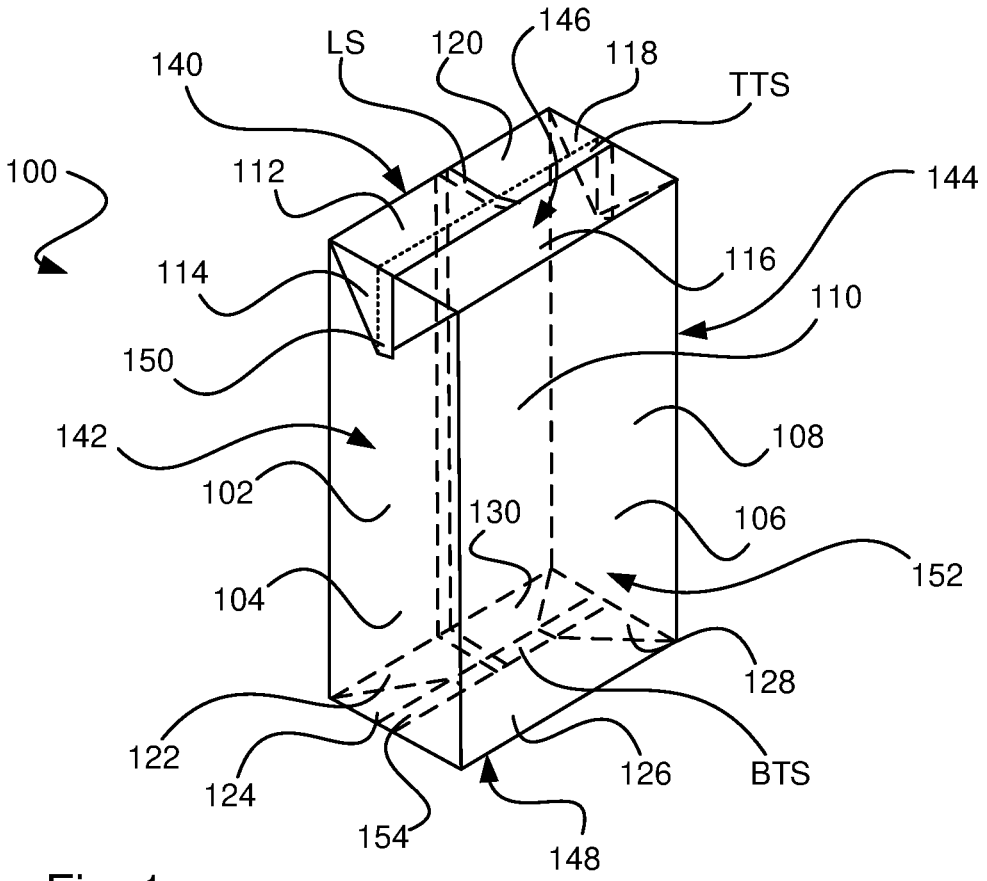
FIG. 1*a* is a perspective view of a package.
Figure 1B:
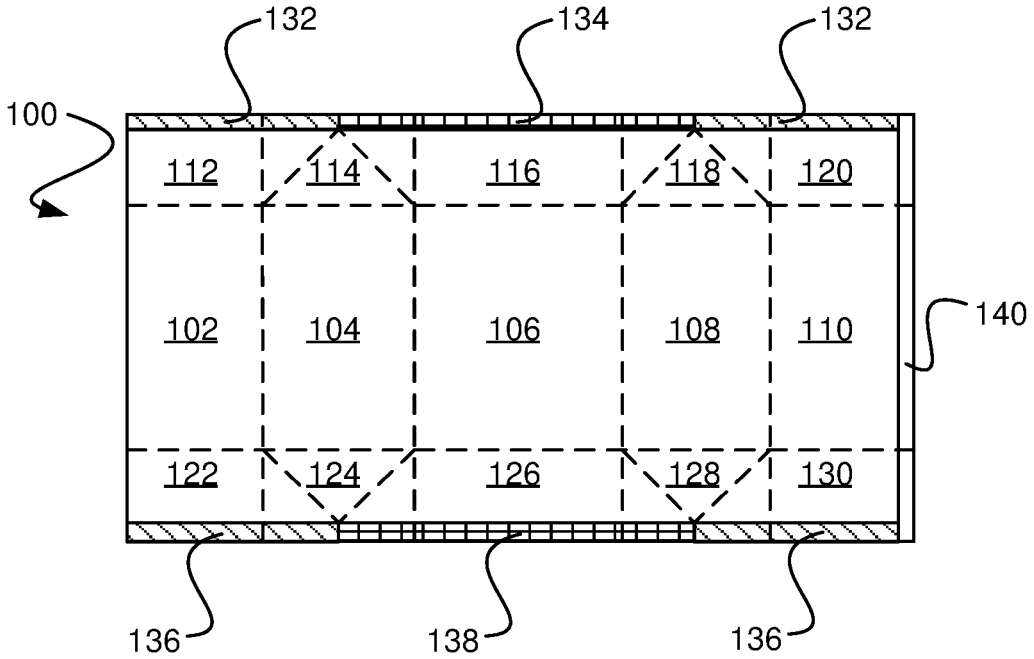
FIG. 1*b* illustrates a piece of packaging material that can be folded into the package illustrated in FIG. 1*a*.

FIG. 1*a* generally illustrates an example of a package 100, herein exemplified by a carton package, made from a piece of package material illustrated in FIG. 1*b*. The package 100 comprises a number of panels divided from each other by weakening lines. The weakening lines provide for that the piece of packaging material can be reliably and efficiently folded into the package 100 by a packaging machine, also known as a filling machine.

In this example, the package 100 comprises a first rear panel 102, a left panel 104, a front panel 106, a right panel 108 and a second rear panel 110, which together form a sleeve-shaped main body of the package 100. As illustrated, the sleeve-shaped main body may have a rectangular cross-section. The first and second rear panel 102, 110 can be attached to each other by a so-called longitudinal sealing LS. In order to avoid that product held in the package comes into contact with interior layers of the packaging material a peripheral part of the second rear panel 110, that is placed inside a peripheral part of the first rear panel 102, can be protected by a plastic strip, sometimes referred to as a longitudinal sealing strip.

Further, the package 100 comprises a first top rear panel 112, a left corner top panel 114, a top front panel 116, a right corner panel 118 and a second top rear panel 120, which together form a top section of the package 100. In a similar manner as the first and second rear panel 102, 110, the first and second rear top panels 112, 120 are attached to each other. In order to close the package 100, the first and second rear top panels 112, 120 are attached to the top front panel 116, two sections of the left corner top panel 114 are attached to each other, and two sections of the right corner top panel 118 are attached to each other. This is provided by a top transversal seal TTS made in the packaging machine after the package is filled with the product, or if filled upside down before the package is filled.

The package 100 also comprises a first bottom rear panel 122, a left corner bottom panel 124, a bottom front panel 126, a right corner bottom panel 128 and a second bottom rear panel 130, which together form a bottom of the package. In a similar manner as the first and second rear panel 102, 110, the first and second bottom rear panels 122, 130 are attached to each other. In order to close the package 100 and thereby form the bottom, the first and second bottom rear panels 122, 130 are attached to the bottom front panel 126, two sections of the left corner bottom panel 124 are attached to each other, and two sections of the right corner bottom panel 128 are attached to each other, such that a bottom transversal seal BTS is formed.

In case the package 100 is produced in a roll-fed packaging machine, a number of pieces of packaging material is provided after one another on a reel of packaging material. By having the pieces of packaging material arranged in this way the top transversal seal TTS can be formed at the same time as the bottom transversal seal BTS is made in a subsequent package. After having made the transversal seals, the packages can be separated from each other by cutting them apart in a section between the transversal seals.

To form the top transversal seal TTS and the bottom transversal seal BTS, a first top seal section 134 and a second top sealing section 132 as well as a first bottom sealing section 136 and a second top sealing section 138 can be provided. After having made the top and bottom transversal seals, the packaging material can be separated such that the first top sealing section 132 and the second top sealing section 134 form an upper part of the top of the package 100, and in the first bottom sealing section 136 and the second bottom sealing section 138 form a lower part of the bottom of the package 100. To form the longitudinal sealing, a longitudinal sealing section 140 can be used.

In case the package is produced in a blanks-fed packaging machine, the longitudinal seal LS is provided beforehand, that is, the first rear panel 102 is attached to the second rear panel 110 via the longitudinal section 140, such that a sleeve-shaped piece of packaging material is provided. In addition, the separation, also referred to as cutting, can be made when producing blanks to be fed into the blanks-fed packaging machine.

In the sleeve-shaped piece of packaging material used for blanks-fed packaging machines, the longitudinal seal LS may be placed in an intersection between a rear section 140 and one of the side sections 142, 144, that is, the rear section 140 of the package 100 may comprise only one panel.

Further, in addition to having different panel arrangements, it is also possible to form a top section 146 and a bottom section 148 in different ways. For instance, as illustrated in FIG. 1*a*, the top section 146 may be formed by folding down a top fin 150, comprising the top transversal seal TTS, towards a front section 152. Another possibility is to fold the top fin 152 towards the rear section 140, that is, towards the longitudinal seal LS. In a similar manner, a bottom fin 154 can be folded down towards the front section 152 or towards the rear section 140.

Figure 2:
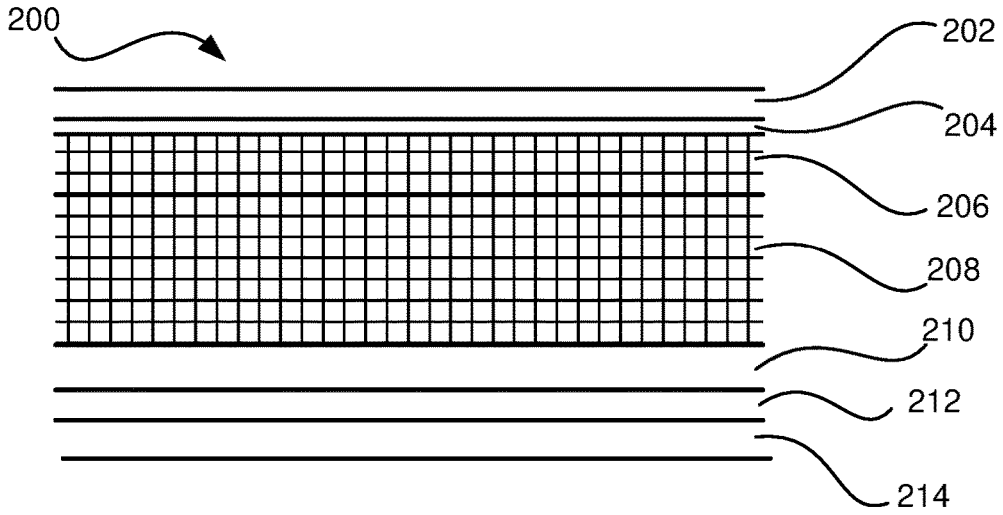
FIG. 2 is a cross-sectional view of a piece of packaging material.

FIG. 2 generally illustrates by way of example a packaging material 200 that can be used for forming the package 100.

Facing the surrounding space, an outer coating 202 may be provided. The outer coating 202 may serve the purpose of avoiding that moisture of water is coming into contact with a printing layer 204 placed inside the outer coating 202. The printing layer 204 can comprise ink or any other material used for providing a print on the package 100.

Inside the printing layer 204, a first and a second paperboard layer 206, 208 can be provided. The first and second paperboard layers 206, 208 provide robustness to the package 100. The first paperboard layer 206 may be bleached paperboard with or without clay coat. The second paperboard layer 208 may be bleached or unbleached paperboard.

Next a lamination layer 210 made of plastic material can be provided. The lamination layer 210 can provide for that microorganisms are hindered from coming into contact with the product held inside the package 100.

Inside the lamination layer 210, an Aluminum foil 212 can be provided. The Aluminum foil 212 can provide for that light, oxygen and odors are hindered from coming into contact with the product held inside the package 100, but also that flavors inside the package can be released from the package 100. The Aluminum foil 212 does however not exist in all types of packaging material. For instance, in the packaging material used for packages for chilled products, i.e. products that will be refrigerated, the Aluminum foil 212 is most often left out and replaced by a combination of lamination layers and paperboard layers.

Closest to the product held inside the package 100, a first and a second internal coating 214, 216, made of e.g. plastics material, can be provided. One purpose with these are that the product is hindered from coming in direct contact with the Aluminum foil 212.

Figure 3A:
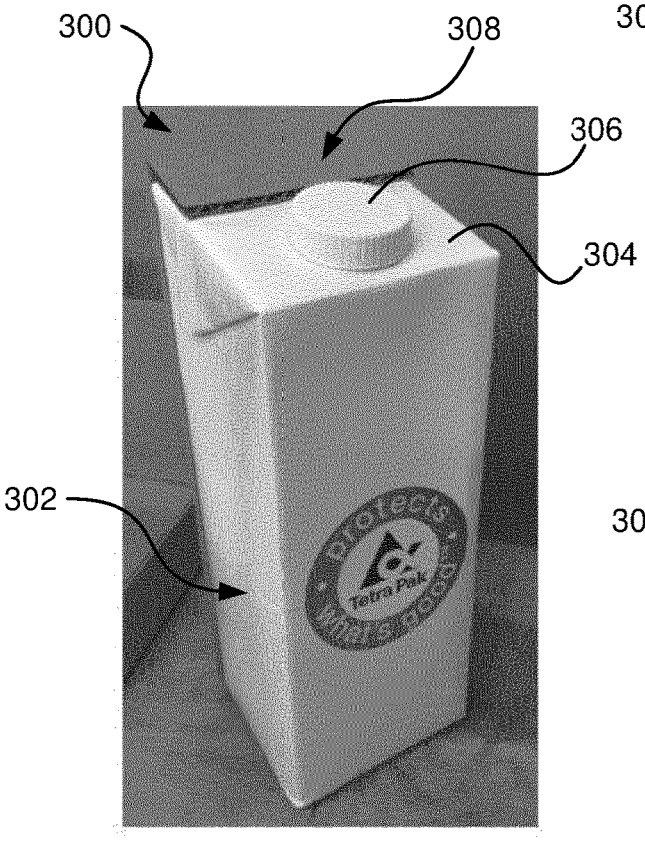
FIGS. 3*a* and 3*b* illustrate two different perspective views of package assembly.
Figure 3B:
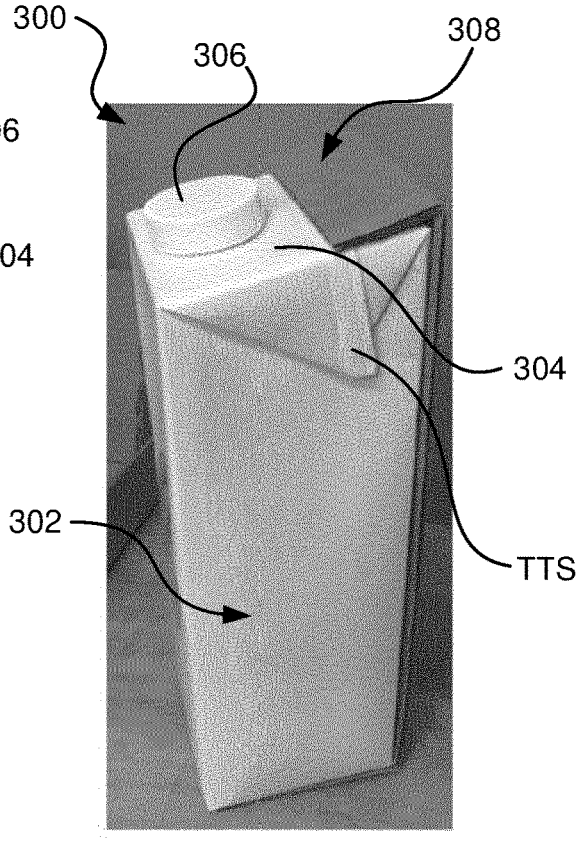

FIGS. 3*a* and 3*b* illustrate by way of example a package assembly 300 comprising a package 302, similar to the package 100 illustrated in FIGS. 1*a* and 1*b*, but with a slanted top section 304 and provided with a cap 306. In addition, to improve robustness and to protect the package 302, an exoskeleton 308 in the form of a cardboard element, that is a piece comprising at least one layer of cardboard, is attached to the package. In this particular example, the exoskeleton 308 is attached to the rear section of the package, to a part of the top section and to the bottom section. By having the exoskeleton 308 attached to the rear section, the longitudinal seal can be protected. By having the exoskeleton 308 attached to the bottom section, the bottom transversal seal can be protected, e.g. in that flaps formed by the left and right corner bottom panels can be securely kept in place. Similarly, by having the exoskeleton 308 attached to part of the top section the top transversal seal TTS can be protected.

As illustrated in FIGS. 3*a* and 3*b* the top transversal seal TTS can be folded down towards the rear section. Since the longitudinal seal LS forms part of the top transversal seal TTS and is placed on the rear section, folding the top transversal seal TTS towards the rear section implies that the longitudinal seal LS is folded, that is, four layers of packaging material is folded. This results in that there is increased risk that the top fin is raised, that is, the top fin does not lay down close to the top section. By having the exoskeleton 308 placed such that this covers at least part of the top transversal seal TTS, the risk that the top fin is raised can be mitigated.

Figure 4A:
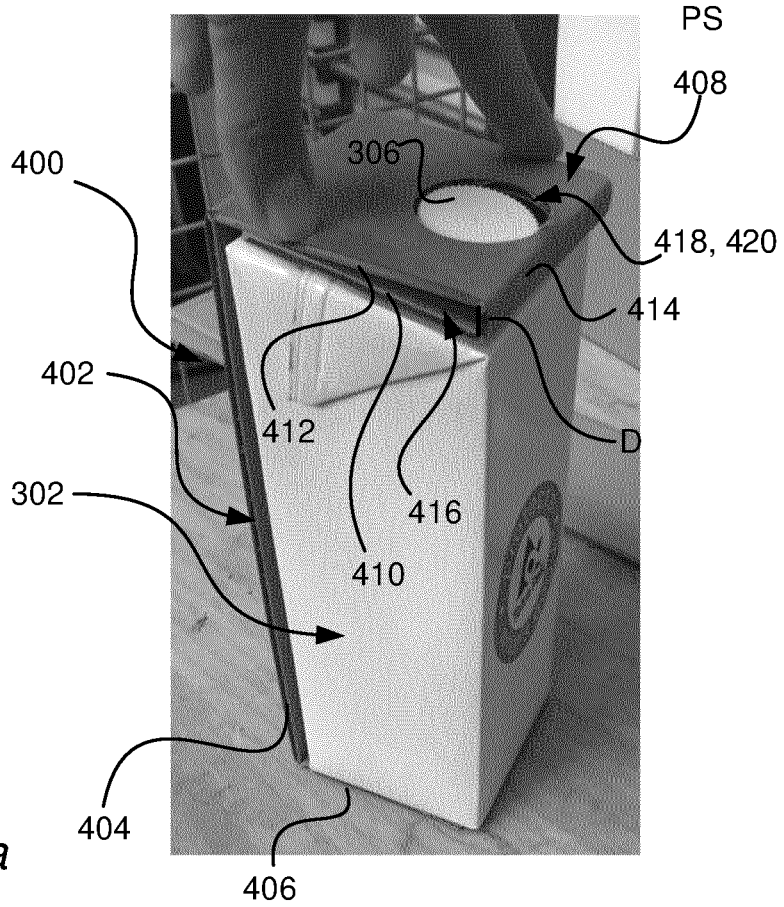
FIG. 4*a* illustrates a perspective view of a package assembly provided with a top protection arrangement.

FIG. 4*a* illustrates another example of a package assembly 400. The exoskeleton 402 used in this exemplified package assembly comprises, in line with the exoskeleton 308 illustrated in FIG. 3, a rear section element 404 attached to the rear section of the package 302, that is, the same type of package as illustrated in FIG. 3, and a bottom section element 406 attached to the bottom section of the package. However, unlike the exoskeleton 308 illustrated in FIG. 3, the exoskeleton 402 illustrated in FIG. 4, is provided with a top protection arrangement 408. The top protection arrangement 408 can be embodied in various ways. As illustrated, a first element 410 may be arranged to face the top section of the package 302, and a second element 412 may be used for forming a flat surface, also referred to as a stacking surface, such that stacking properties can be improved. To form the flat surface, when the package 302 is provided with the slanted top section 304, as illustrated in FIG. 3, a third element 414 may be used. The third element 414 may be connected to the first and second element 410, 412 such that the top protection arrangement is wedge-shaped and thereby compensate for the slanted top section such that the flat surface can be obtained. In the illustrated example, the second element 412 is attached to the rear section element 404, but it is also possible to have the first element 410 attached to the rear section element 404.

Due to the third element 414, the first and second element 410, 412 can be held at a distance D from each other. As an effect, a space 416 between the first and second element 410, 412 can be formed. In a protective state, illustrated in FIG. 4*a*, the cap 306 can be held in the space 416. To fit the cap 306 in the space 414, a first opening 418 may be provided in the first element and a second opening 420 may be provided in the second element 412. Further, even though not illustrated, if e.g. having a low profile cap, only the second opening 420, that is, the opening in the element closest to the top section, may be required to fit the cap in the space. Still an option, if having e.g. another type of opening device than the cap 306, such as a pull tab or a straw hole, the first and the second opening 418, 420 may be left out.

Figure 4B:
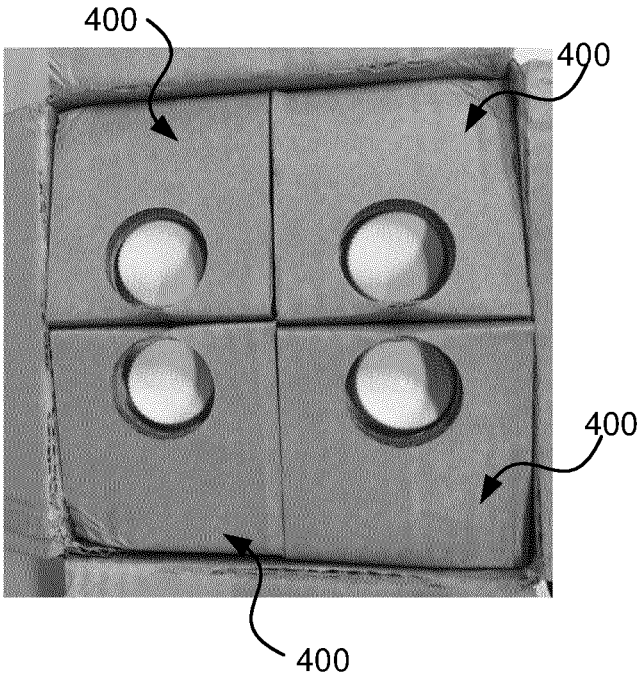
FIG. 4*b* illustrates a box filled with four package assemblies seen from above.

FIG. 4*b* illustrates by way of example four package assemblies 400, illustrated in FIG. 4*a*, placed in a cardboard box. By having the package assemblies 400 provided with the top protection arrangements 408, a risk that the top sections are damaged during transport can be reduced. This may by way of example be relevant in e-commerce when the packages 302 are distributed by ordinary mail package services.

Figure 5:
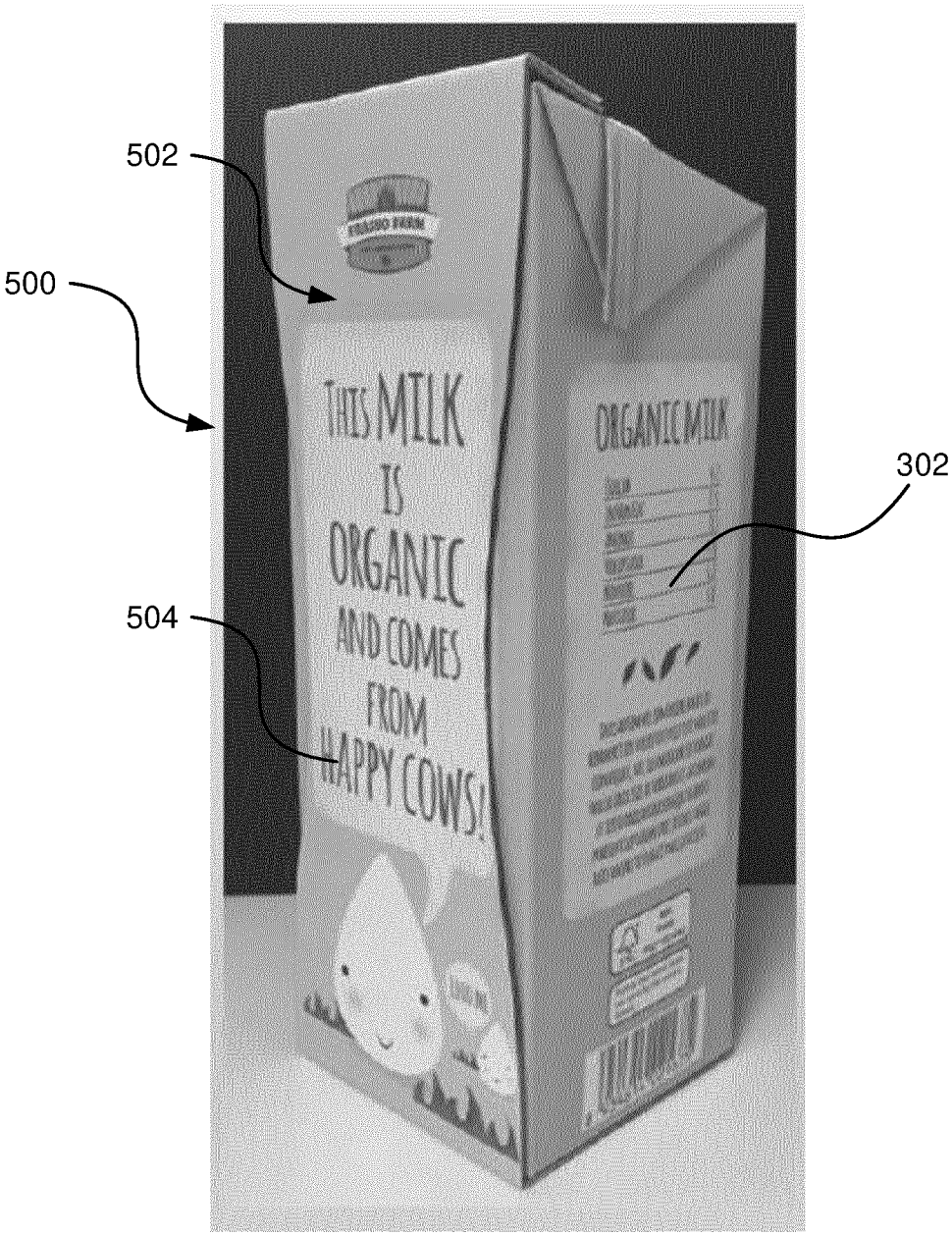
FIG. 5 illustrates a perspective view of a package assembly provided with an hourglass-shaped rear section.

FIG. 5 illustrates another example of a package assembly 500. The package 302, similar to the packages illustrated in FIGS. 3 and 4, has an exoskeleton 502 attached thereto that has a rear section element 504 that is different from the rear section of the package. For instance, as illustrated, the rear section of the package 302 may be rectangular-shaped, while the rear section element 504 is hourglass-shaped. Apart from providing a visual appeal, an advantage is that a user may be directed on how to grip the package assembly 500 when using it. Further, by having the rear section element 504 provided with a width being smaller than the width of the rear section, the package assembly 500 can be easier for the user to grip, in particular if the packaging material 200 the package 302 provides more flexibility than the exoskeleton 502.

FIGS. 6 to 13 illustrate eight different examples of exoskeletons that can be attached to packages.

Figure 6:
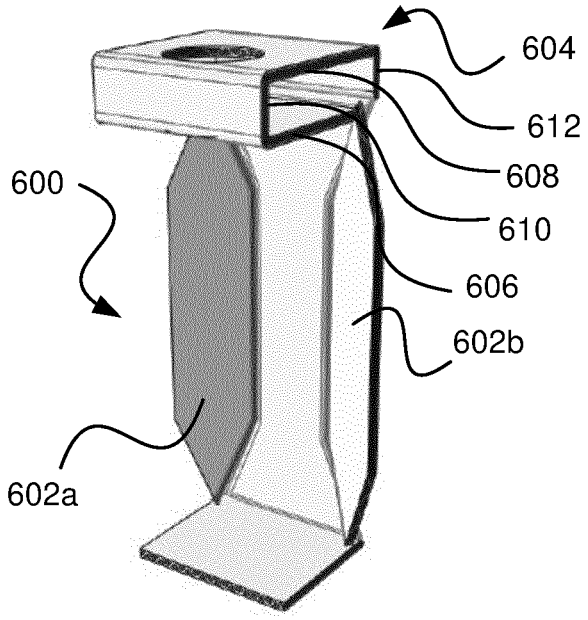
FIGS. 6 to 13 illustrate various examples of exoskeletons.

FIG. 6 illustrates a first example of an exoskeleton 600 in isolation. The exoskeleton 600 comprises a first and a second intermediate section element 602*a*, 602*b* that can be attached to intermediate sections of a package, that is, sections placed between the side sections and the rear section of the package. An example of a package with intermediate sections is Tetra Prisma™ sold and marketed by Tetra Pak™.

The exoskeleton 600 is further provided with a top protection arrangement 604 that comprises a first element 606 arranged to face the top section of the package, a second element 608 placed at a distance from the first element 606, a third element 610 connecting the first and second element 606, 608 and a fourth element 612 connected to the second element 608. As the top protection arrangement 408 illustrated in FIG. 4*a*, the top protection arrangement 604 is arranged to protect the top section of the package as well as the cap during transportation. In the protective state PS, the first element may be attached to the top section of the package, and the elements may be divided by folding lines such that the top protection arrangement 604 can be moved easily between the protective state PS and a non-protective state NPS, that is, when at least part of the top protection arrangement 604 has been removed or displaced by the user.

Figure 7:
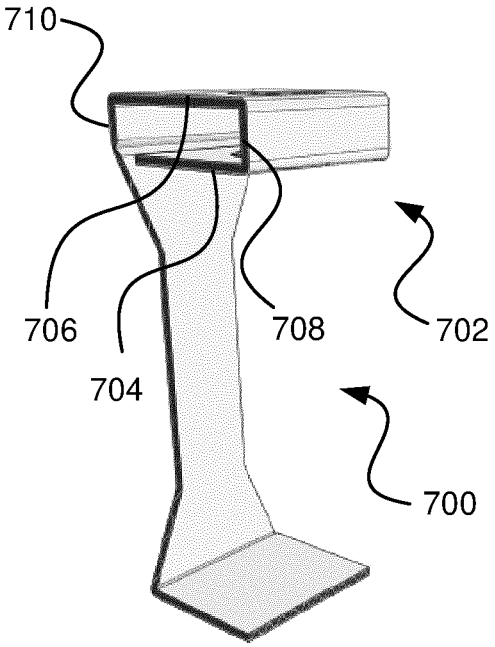

FIG. 7 illustrates another example of an exoskeleton 700. The exoskeleton 700 is provided with an hourglass-shaped rear section element that can be attached to the same type of package as the exoskeleton 600 illustrated in FIG. 6, but unlike the exoskeleton 600 illustrated in FIG. 6, the exoskeleton 700 is not provided with intermediate side section elements. The exoskeleton 700 may also be attached to a brick-shaped package, such as Tetra Brik™ marketed by Tetra Pak™, such that a package assembly similar to the package assembly 500 illustrated in FIG. 5 can be achieved.

The exoskeleton 700 can be provided with a top protection arrangement 702. This may comprise a first element 704 arranged to face the top section of the package, a second element 706 arranged to form the flat surface, spaced apart from the first element 704, a third element 708 connecting the first and second element 704, 706, a fourth element 710 connecting the second element 706 to the rear section. Folding lines may be provided between the different elements such that the top protection arrangement 702 can be removed by the user before opening the package.

Figure 8:
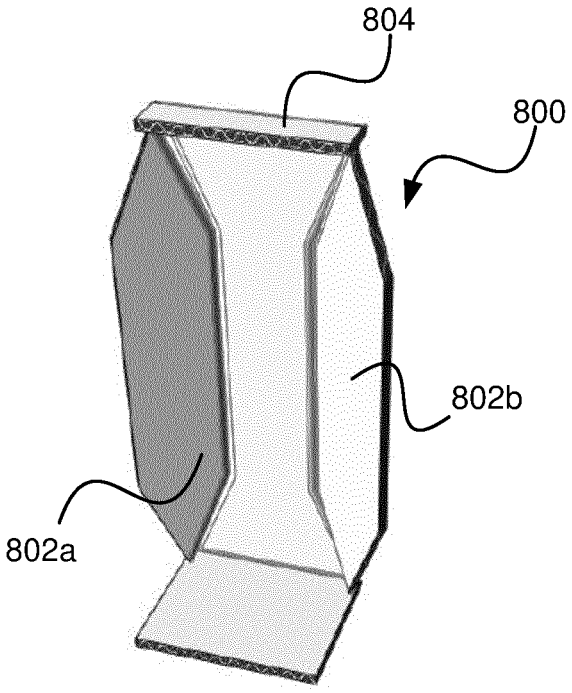

In FIG. 8 yet another example of an exoskeleton 800 is illustrated. As the exoskeleton 600 illustrated in FIG. 6, the exoskeleton 800 is provided with a first and second intermediate section elements 802*a*,*b*. Since the first and second intermediate section elements 802,802*b* is inclined with respect to the rear section element of the exoskeleton 800, having the intermediate section elements may provide increased robustness to the package assembly. Further, even though two intermediate section elements are illustrated, another option is to have the exoskeleton 800 provided with only one intermediate section element. The same holds true for the exoskeleton 600 illustrated in FIG. 6. Unlike the exoskeleton 600 illustrated in FIG. 6, the exoskeleton 800 is only provided with a first element 804.

Figure 9:
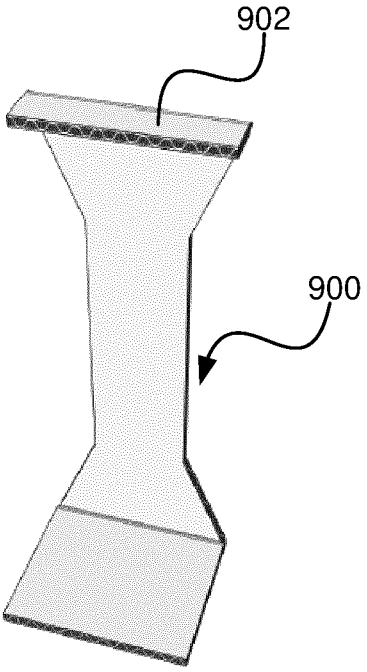

In FIG. 9 still another example of an exoskeleton 900 is illustrated. As the exoskeleton 700 illustrated in FIG. 7, the exoskeleton 900 can, for the same reasons as mentioned above with respect to FIG. 7, be provided with a rear section element that is non-rectangular. As the exoskeleton 800 illustrated in FIG. 8, a first element 902 may be provided for protection of the top section of the package.

Figure 10:
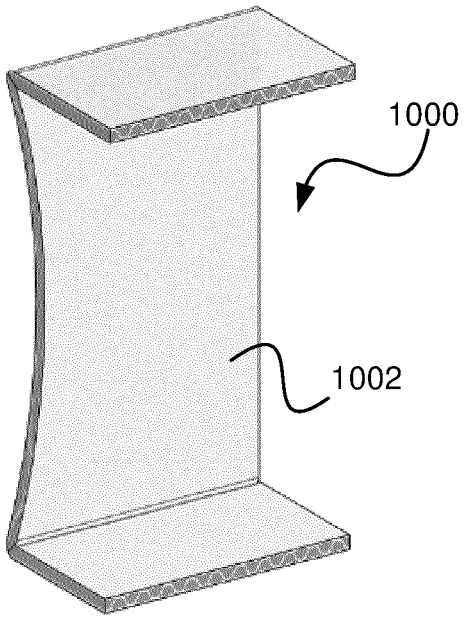

Still an example of an exoskeleton 1000 is illustrated in FIG. 10. The exoskeleton 1000 can be provided with a rear section element 1002 with one side being straight and the other side being curved. In line with the first and second intermediate section elements 602,602*b* illustrated in FIG. 6, the curved side may be provided to fit with the package to which the exoskeleton is to be attached, or it may, e.g. if the exoskeleton 1000 is to attached to the package 302 with rectangular-shaped rear section, illustrated in FIGS. 3*a* and 3*b*, provide improved gripping properties.

Figure 11:
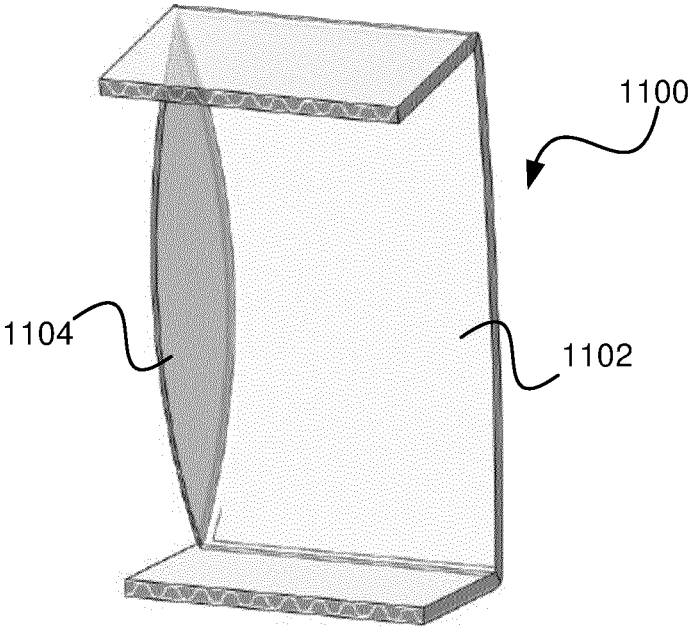

A further example of an exoskeleton 1100 is illustrated in FIG. 11. In line with the exoskeleton 1000 illustrated in FIG. 10, the exoskeleton 1100 can be provided with a rear section element 1102 with one side being straight and the other side being curved. Further, a first intermediate side section 1104 may be provided. In line with the first and second intermediate section elements 602,602*b* illustrated in FIG. 6, the first intermediate section element 1104 may be provided to fit with the package to which the exoskeleton is to be attached.

Figure 12:
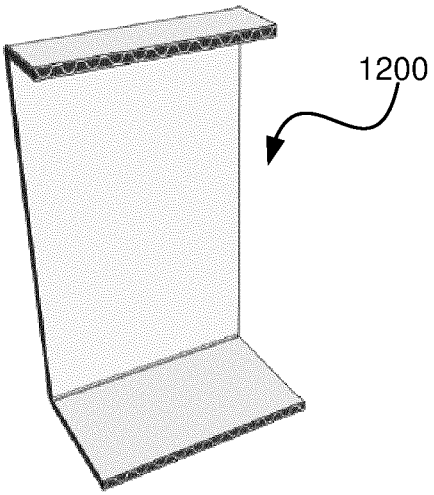

A further example of an exoskeleton 1200 is illustrated in FIG. 12. The exoskeleton 1200 is provided with a rear section element that is rectangular-shaped, a top section element for protecting the top section of the package and a bottom section element for protecting the bottom section.

Figure 13:
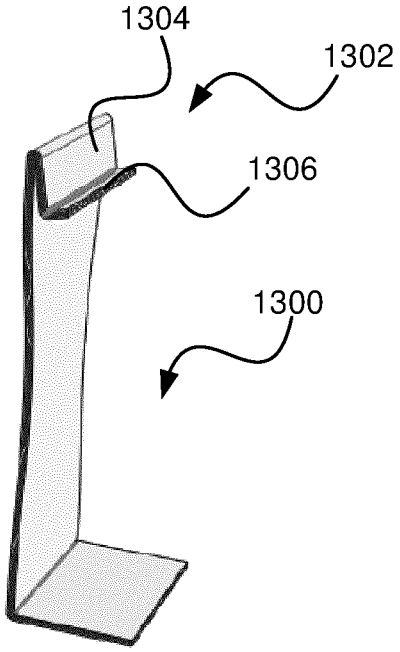

Still an example of an exoskeleton 1300 is illustrated in FIG. 13. The exoskeleton 1300 is provided with an upper flap 1302 that is arranged to extend above the package to which it is attached. The upper flap 1302 may comprise of a rear section element that is arranged to extend above the rear section of the package, a flap element 1304 and a top section element 1306 arranged to be attached to the top section of the package. The upper flap 1302 may be provided with e.g. an opening such that the package assembly formed when the exoskeleton is attached to the package can be hanged on a hook.

Figure 14:
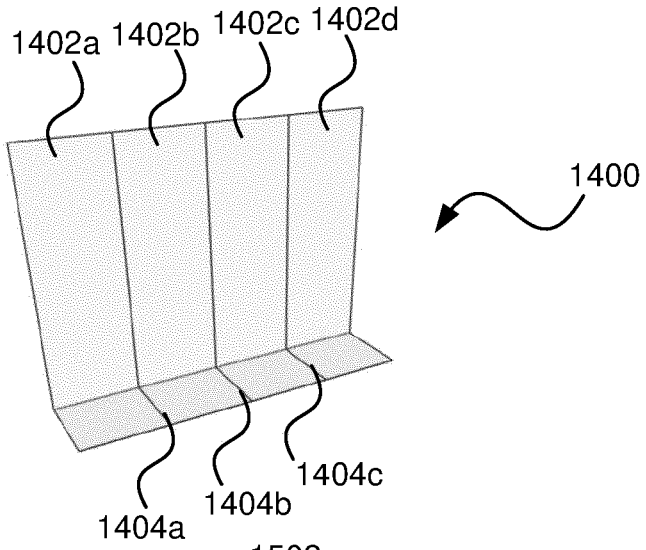
FIGS. 14 to 16 illustrate various examples of exoskeletons that can be used for producing multi-packs.

In FIG. 14, a group 1400 comprising a number of exoskeletons 1402*a*, 1402*b*, 1402*c*, 1402*d* that can be attached to a number of packages such that a multipack is formed is illustrated by way of example. The exoskeletons 1402*a*, 1402*b*, 1402*c*, 1402*d* each comprises the rear section element and the bottom section element. To provide for that a user can separate the exoskeletons from each other, i.e. to be able to separate the package assemblies from each other when the multi-pack is formed, perforation lines 1404*a*, 1404*b*, 1404*c* may be provided.

Figure 15:
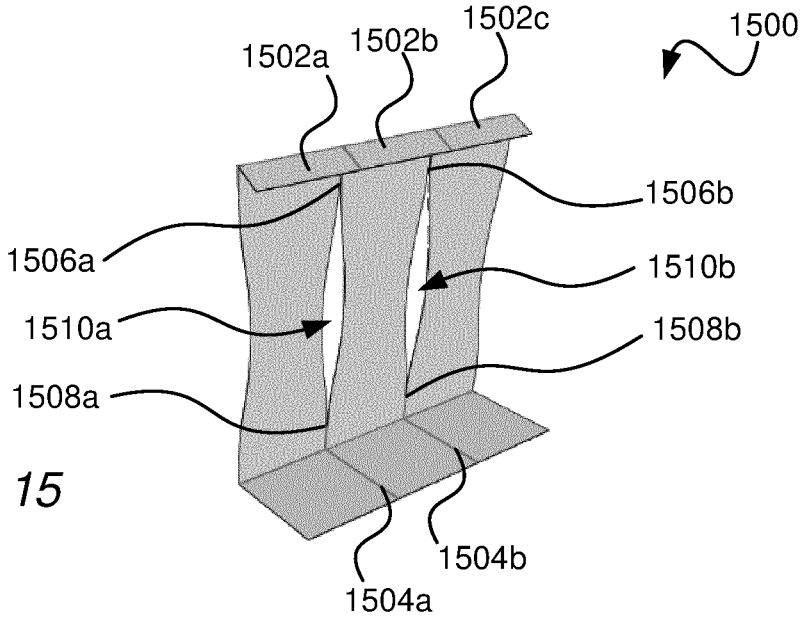

In FIG. 15, a group 1500 comprising a number of exoskeletons 1502*a*, 1502*b*, 1502*c* connected via perforation lines 1504*a*, 1504*b*, 1504*c*, also referred to as tearing lines, is illustrated by way of example.

The rear section elements of the exoskeletons 1502*a*, 1502*b*, 1502*c* may be attached to each other in first attachment sections 1506*a*, 1506*b* and second attachment sections 1508*a*, 1508*b*. The first attachment sections 1506*a*, 1506*b* and the second attachment sections 1508*a*, 1508*b* may be spaced apart and openings 1510*a*, 1510*b* may be provided between them as illustrated. An advantage of having the first and second attachment sections 1506*a*, 1506*b*, 1508*a*, 1508*b* may be that separation of the package assemblies can be facilitated.

Figure 16:
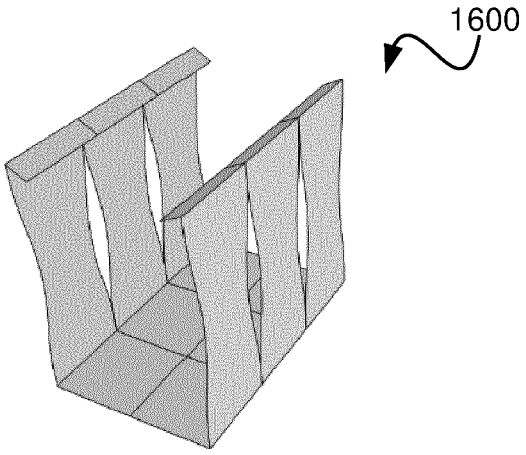

In FIG. 16, yet another group 1600 of exoskeletons is illustrated by way of example. The exoskeletons of the group 1600 are similar to the exoskeletons of the group 1500 illustrated in FIG. 15, but in addition to the group 1500 illustrated in FIG. 15, the group 1600 is connected such that a 2×3 multi-pack can be achieved. Put differently, the group 1600 is designed such that packages can be placed side-to-side as well as front-to-front.

Figure 17:
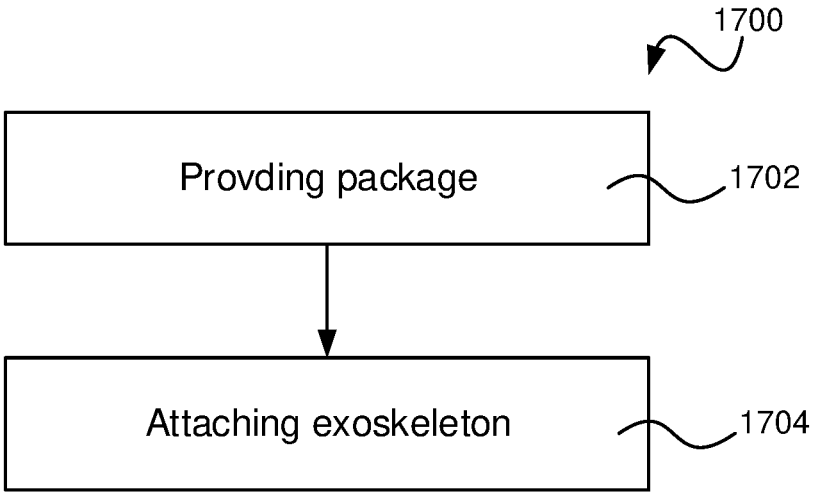
FIG. 17 is a flowchart illustrating a method for producing a package assembly.

FIG. 17 is a flow chart illustrating a method for producing the package assembly. In a first step 1702, the package is provided, and in a second step 1704 the exoskeleton is attached to the rear section of the package such that an improved robustness is achieved and that the longitudinal seal is protected.

Figure 18:
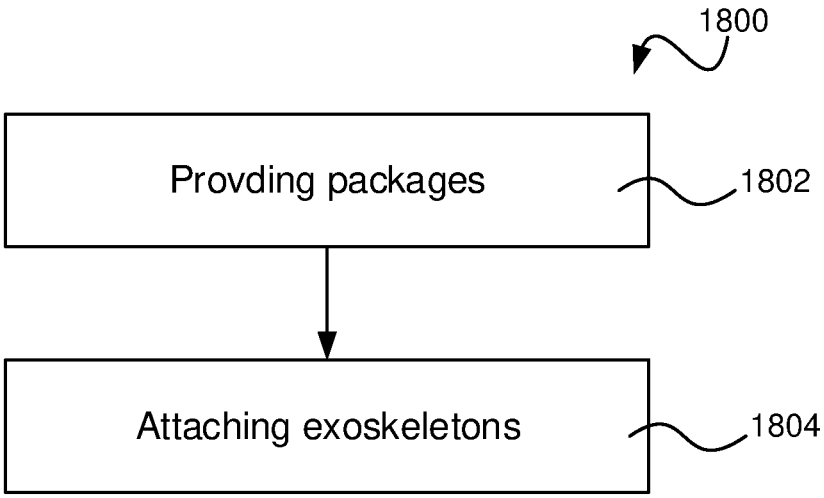
FIG. 18 is a flowchart illustrating a method for producing a multi-pack.

FIG. 18: Method Forming Multi-Pack

FIG. 18 is a flow chart illustrating a method for producing the multi-pack In a first step 1802, the packages are provided, and in a second step 1704 the exoskeletons are attached to the rear sections of the packages such that an improved robustness is achieved, that the longitudinal seals are protected, and that the packages are attached to each other.

From the description above follows that, although various embodiments of the invention have been described and shown, the invention is not restricted thereto, but may also be embodied in other ways within the scope of the subject-matter defined in the following claims.

The invention claimed is:

1. A package assembly comprising a package arranged to hold a food product, wherein the package comprises a rear section provided with a longitudinal seal, and a top section with an opening device, an exoskeleton attached to the rear section of the package, the exoskeleton configured to protect the longitudinal seal, wherein the exoskeleton comprises: a rear section element attached to the rear section of the package, and a top protection arrangement configured to be positioned in a protective state, said top protection arrangement comprises: a first element that in the protective state is arranged to face the top section of the package, a second element that in the protective state is arranged to form a stacking surface of the package assembly, and a third element connected to the first and second element, and that in the protective state is arranged to provide a distance between the first and second element such that a space is formed.

2. The package assembly according to claim 1, wherein the package further comprises a-top section comprises a top transversal seal, and the exoskeleton is arranged to face the top section such that the top transversal seal is protected.

3. The package assembly according to claim 2, wherein the top transversal seal is provided in a top fin, and the top fin is folded towards the longitudinal seal, wherein the exoskeleton is arranged to face the top fin that forms part of the top section such that the top fin is held in place.

4. The package assembly according to claim 1, wherein the package further comprises a bottom section provided with a bottom transversal seal, and the exoskeleton is attached to the bottom section such that the bottom transversal seal is protected.

5. The package assembly according to claim 1, wherein the opening device is a cap, and the first element is provided with a first opening for holding the cap in the protective state, and the space is arranged for holding the cap in the protective state between the first and second element.

6. The package assembly according to claim 5, wherein the second element is provided with a second opening for holding the cap in the protective state.

7. The package assembly according to claim 1, wherein the top section is a slanted top section.

8. The package assembly according to claim 1, wherein the package comprises a side section placed next to the rear section, and an intermediate section placed between the rear section and the side section, wherein the exoskeleton is attached to the intermediate section.

9. The package assembly according to claim 1, wherein the exoskeleton comprises a cardboard layer.

10. A multi-pack comprising a number of package assemblies according to claim 1, wherein a number of exoskeletons of the number of package assemblies are attached to each other.

11. The multi-pack according to claim 10, wherein rear section elements of the number of package assemblies are attached to each other in a first attachment section and a second attachment section, wherein the first and second attachment sections are spaced apart from each other.

12. The multi-pack according to claim 10, wherein bottom section elements of the exoskeletons are attached to each other.

* * * * *